US007860442B2

(12) United States Patent
Nishikawa et al.

(10) Patent No.: US 7,860,442 B2
(45) Date of Patent: Dec. 28, 2010

(54) IMAGE FIXING DEVICE HAVING CARBON LAMP AND REFLECTOR

(75) Inventors: Tetsuji Nishikawa, Tokyo (JP); Takayuki Niihara, Atsugi (JP); Kazuki Suzuki, Yokohama (JP); Kazunori Bannai, Atsugi (JP); Makoto Kikura, Yokohama (JP); Yasuhiro Maehata, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 814 days.

(21) Appl. No.: 11/773,206

(22) Filed: Jul. 3, 2007

(65) Prior Publication Data

US 2008/0124152 A1 May 29, 2008

(30) Foreign Application Priority Data

Jul. 3, 2006 (JP) ..... 2006-183189
Mar. 16, 2007 (JP) ..... 2007-068563

(51) Int. Cl.
*G03G 15/20* (2006.01)

(52) U.S. Cl. ..... 399/329; 399/333

(58) Field of Classification Search ..... 399/328–330, 399/333; 219/216; 392/417, 421
See application file for complete search history.

(56) References Cited

U.S. PATENT DOCUMENTS 4,435,069 A * 3/1984 Sato ..... 219/216
2006/0289418 A1* 12/2006 Konishi et al. ..... 219/216

FOREIGN PATENT DOCUMENTS

| | | |
|---|---|---|
| JP | 2000-047507 | 2/2000 |
| JP | 2003-215964 | 7/2003 |
| JP | 2003-223064 | 8/2003 |
| JP | 2004-101731 | 4/2004 |
| JP | 2004-309975 | 11/2004 |
| JP | 2005-114959 | 4/2005 |

OTHER PUBLICATIONS

U.S. Appl. No. 12/169,217, filed Jul. 8, 2008, Yamada, et al.

* cited by examiner

*Primary Examiner*—William J Royer
(74) *Attorney, Agent, or Firm*—Oblon, Spivak, McClelland, Maier & Neustadt, L.L.P.

(57) ABSTRACT

An image fixing device for use in an image forming apparatus. The fixing device includes a fixing member which fixes a toner image on a recording medium at a nip area, a pressurizing member which pressures the recording medium toward the fixing member at the nip area, a carbon lamp which emits infrared rays, and a reflecting member which reflects the infrared rays to the nip area.

19 Claims, 9 Drawing Sheets

FIG. 9

STRUCTURE FORMULAS AND WAVE NUMBERS OF THE INFRARED PROPERTY ABSORPTION BAND

| TYPE OF MOLECULAR VIBRATION | WAVE NUMBER, $\bar{\nu}$ /cm-1 | SHAPE OF CHEMICAL COMPOUND |
|---|---|---|
| -OH STRETCHING VIBRATION | 3600 ~ 3200 | $H_2O$, ROH |
| -NH STRETCHING VIBRATION | 3400 ~ 3100 | AMINE, AMIDO GROUP |
| ≡C-H STRETCHING VIBRATION | 3300 ~ 3270 | R-C≡CH |
| =C-H STRETCHING VIBRATION | 3100 ~ 3000 | AROMA, OLEFIN COMPOUND |
| -C-H STRETCHING VIBRATION | 2960 ~ 2850 | SATURATED HYDROCARBON |
| -C≡N STRETCHING VIBRATION | 2250 ~ 2200 | RCN, ArCN |
| >C=O STRETCHING VIBRATION | 1820 ~ 1650 | CARBONYL COMPOUND |
| >C=C< STRETCHING VIBRATION | 1680 ~ 1640 | UNSATURATED HYDROCARBON |
| $-NH_2$ SCISSOR VIBRATION | 1640 ~ 1560 | $R-NH_2$ |
| VIBRATION OF RING STRUCTURE | 1610 ~ 1590 | BENZENE DERIVATIVE |
| | 1500 ~ 1480 | BENZENE DERIVATIVE |
| $-CH_2$ SCISSOR VIBRATION | ~ 1450 | SATURATED HYDROCARBON |
| $-CH_3$ DEGENERATE VIBRATION | ~ 1450 | SATURATED HYDROCARBON |
| $-CH_3$ SYMMETRIC VIBRATION | 1380 | SATURATED HYDROCARBON |
| C-O STRETCHING VIBRATION | 1080 ~ 1050 | ALCOHOL, ESTER |
| >C=C-H OUT-OF-PLANE VIBRATION | 990 ~ 965 | $RCH=CH_2$, RHC=CHR |
| CH OUT-OF-PLANE VIBRATION | 880 ~ 720 | BENZENE SUBSTITUTED COMPOUND |
| C-CI STRETCHING VIBRATION | 780 ~ 615 | RC-CI GROUP |

R : ALKYL GROUP, Ar : ARYL GROUP

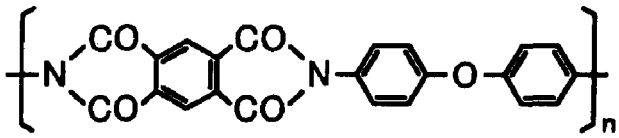
FIG. 10A POLYPYROMELLITICIMIDE (POLYIMIDE PRODUCED BY DEGENERATIVE REACTION)
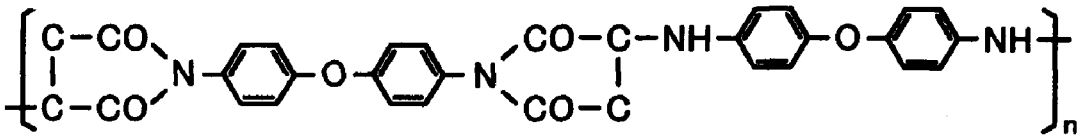
FIG. 10B POLYAMINOBISMALEIMIDE (POLYIMIDE PRODUCED BY ADDITIONAL REACTION)

($R_1$, $R_2$ GROUPS MAY BE SELECTED IN $-H$, $-CH_3$, $-OH$, $CH_2 = CH-$ AND SO ON.)

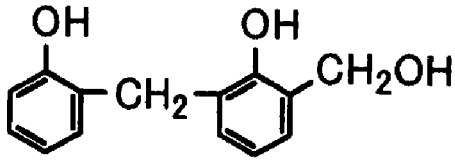
FIG. 13A
RESOL TYPE
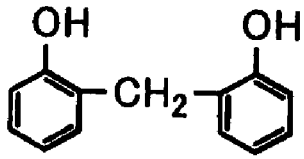
FIG. 13B
NOVOLAK TYPE
FIG. 14
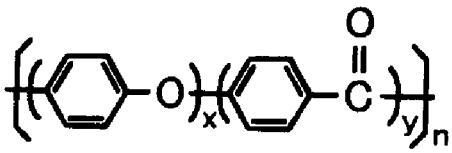

IMAGE FIXING DEVICE HAVING CARBON LAMP AND REFLECTOR

CROSS-REFERENCE TO RELATED APPLICATION

This patent specification is based on two Japanese patent applications, No. 2006-183189 filed on Jul. 3, 2006 in the Japan Patent Office and No. 2007-068563 filed on Mar. 16, 2007 in the Japan Patent Office, the entire contents of which are incorporated by reference herein.

BACKGROUND OF THE INVENTION

1. Field of the Invention

The present invention relates to an image forming apparatus, such as a copy machine, a printer, a facsimile machine, and a multi-function machine capable of copying, printing, and faxing, and more particularly to an image fixing device which uses a carbon lamp.

2. Description of the Related Art

An image fixing device is disclosed in Laid-open Japanese Patent Application No. 2003-215964 as Patent Reference 1. This image fixing device is improved to suppress an inrush current at an initial energization of a heater used for a fixing device for an image forming apparatus. A thermal fixing device of paper having an unfixed image may be implemented using a halogen lamp and a carbon lamp which heat a fixing roller. The carbon lamp radiates more far infrared radiation larger than the halogen lamp. The halogen lamp is usually inside the core of the fixing roller, and the carbon lamp is arranged mechanically parallel to and near the halogen lamp. The carbon lamp is electrically connected to the halogen lamp in series or parallel. The halogen lamp, which is used as a conventional heat source, lets an inrush current occur when the halogen lamp is in a cool state because a resistance of the halogen lamp is low. The inrush current causes a voltage drop and a lighting flicker for the halogen lamp. To prevent the voltage drop and the lighting flicker, the electronic power source of the halogen lamp needs to have a large source capacity or a current control system.

Patent Reference 1 discloses that the image fixing device solves the voltage drop and a lighting flicker. The image fixing device has the halogen lamp as a first heating member and the carbon lamp as a second heating member for heating the fixing roller. The carbon lamp is one part of a protecting circuit to prevent the inrush current from occurring. However it is not cost effective to arrange both the halogen lamp and the carbon lamp in the fixing roller. Moreover to arrange both the halogen lamp and the carbon lamp in the fixing roller makes it difficult to downsize the heating member. A large heating member makes a heat capacity large and the large heat capacity of the fixing roller makes the time for heating the fixing roller large.

SUMMARY OF THE INVENTION

The invention presented in this application prevents the inrush current from occurring with a simple structure. Further, the invention allows the electric power source capacity to be smaller as the power source does not need to supply the inrush current.

According to an aspect of the invention, an image fixing device for use in an image forming apparatus includes a fixing member which fixes a toner image on a recording medium at a nip area, a pressurizing member which pressures the recording medium toward the fixing member at the nip area, a carbon lamp which emits infrared rays, and a reflecting member which reflects the infrared rays to the nip area. The carbon lamp and the reflecting member suppress an inrush current at an initial energization, and allow the electric source capacity to be small. Moreover, a carbon lamp and the reflecting member make the time of heating up the fixing member short and effectively melt and press toner at the nip area. The reflecting member reflects the infrared rays to a most upstream portion of the nip area in the conveying direction of the recording medium. This reflecting member heats toner at the beginning of proceeding the nip area and prevents ineffectual loss of heat. Moreover, the thermistor which is a detecting member for detecting temperature of the fixing member and is opposed to the inner side of fixing member prevents the accuracy of detecting temperature from dropping.

The fixing member includes a plurality of materials which have different heat absorptivities. The plurality of materials allows better absorption of the heat energy corresponding to the wavelength range of the infrared rays emitted by the carbon lamp. Moreover, the fixing member is made with at least a first layer which contacts the recording medium, a second layer which conveys heat to the first layer, and a third layer which includes a surface facing the carbon lamp. The first, second, and third layers have different heat absorptivities, and convey heat from the third layer, whose heat absorptivity is the highest in the layers of the fixing member, to the first layer which is next to the recording medium. The third layer absorbs the far infrared rays corresponding to the infrared rays given off from the carbon lamp whose wavelength range is mainly from 1 to 10 μm.

The material of the third layer is made with heat resistant resin, and prevents the third layer from a deformation or a chemical change caused by the heat of the carbon lamp. The thickness of the third layer is 0.5 mm or less and makes the heat capacity of the fixing member small. The small heat capacity of the fixing member reduces the heat up time at the nip area of the fixing member.

The carbon lamp includes the evaporated reflecting member on the surface of the lamp. The evaporated reflecting member does not need an attachment structure of the reflecting member, and downsizes the image fixing device. A small image fixing device has a small heat capacity and the small heat capacity of the small image fixing device also reduces the heat up time at the nip area of the fixing member. According to one embodiment, the image fixing device includes a plurality of carbon lamps arranged in the width direction of the fixing member which give off a limited infrared ray selectively corresponding to the different widths of the recording mediums. The plurality of carbon lamps prevent the excess heating up at both ends of the fixing member in the width direction where the recording medium does not contact but the fixing member directly contacts with the pressurizing member. The heat damage at both ends is decreased and the heating efficiency is increased.

BRIEF DESCRIPTION OF THE DRAWINGS

FIG. 9 is a table of structure formulas and wave numbers of the infrared property absorption band;

FIGS. 10A and 10B describe suitable polyimides;

FIGS. 13A and 13B describe suitable phenols;

FIG. 14 describes a suitable ketone;

DESCRIPTION OF THE PREFERRED EMBODIMENTS

Figure 1:
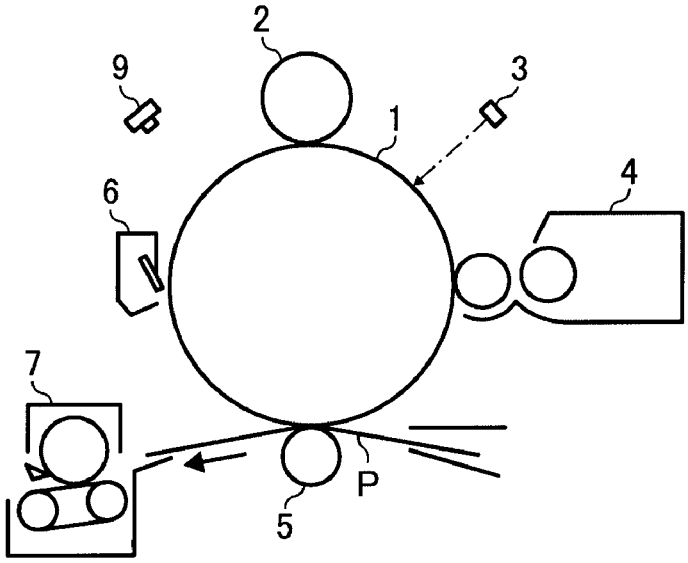
FIG. 1 is a schematic view of an image forming apparatus having a fixing device of a first embodiment.

In describing example embodiments shown in the drawings, specific terminology is employed for the sake of clarity. However, the disclosure of this present invention is not intended to be limited to the specific terminology so selected and it is to be understood that each specific element includes all technical equivalents that operate in a similar manner. In the following, the same reference mark is given to the same device in the drawings, and explanations thereof are not repeated.

FIG. 1 is a schematic view of a simple image forming apparatus which includes a fixing device of first embodiment. This image forming apparatus uses a single color toner and may be considered a simple image forming apparatus. As shown in FIG. 1, the simple color image forming apparatus includes a photoconductive drum 1, a charge roller 2 that charges the surface of the photoconductive drum 1, an exposure device 3 that irradiates an exposure light, which is shown as an arrow based on image information, a developing device 4 that develops a toner image corresponding to the image information on the photoconductive drum 1, a transferring roller 5 that transfers the toner image on the photoconductive drum 1 to a recording medium P, a cleaning device 6 that removes a residual toner on the photoconductive drum 1 and a quenching lamp 9 that quenches a residual electric potential on the surface of the photoconductive drum 1. With reference to FIG. 1, image forming operations of the image forming apparatus are described. First, the charge roller 2 charges the surface of the photoconductive drum 1 uniformly. The exposure device 3 irradiates the exposure light, such as a laser beam, based on image information to the surface of the photoconductive drum 1. The exposure device 3 may be any type of light irradiator such as a laser based polygonal mirror system, an LED or laser array, a system which is based on an analog system, or any other type of light irradiating or emitting system. The photoconductive drum 1 rotates clockwise, and a toner image corresponding to the image information is formed on the photoconductive drum 1 by the developing device 4. Then, the toner image formed on the photoconductive drum 1 is transferred to the recording medium P by the transferring roller 5, which is conveyed to the transferring roller 5 by a plurality of conveying rollers (not shown) arranged upstream of the transferring roller 5 in the conveying direction of the recording medium P. Then, the recording medium P, on which the toner image is transferred, is conveyed to an image fixing device 7. There, the toner image is fixed by heat and pressure provided by the fixing device 7. Then, the recording medium P to which the toner image is fixed is discharged from the fixing device 7 to a delivery tray (not shown). The cleaning device 6 removes residual toner on the photoconductive drum 1 that is not transferred to the recording medium P. Then the quenching lamp 9 quenches residual electric potential on the photoconductive drum 1 from which the residual toner has been removed. In this way, a series of image formation processes is completed.

Figure 2:
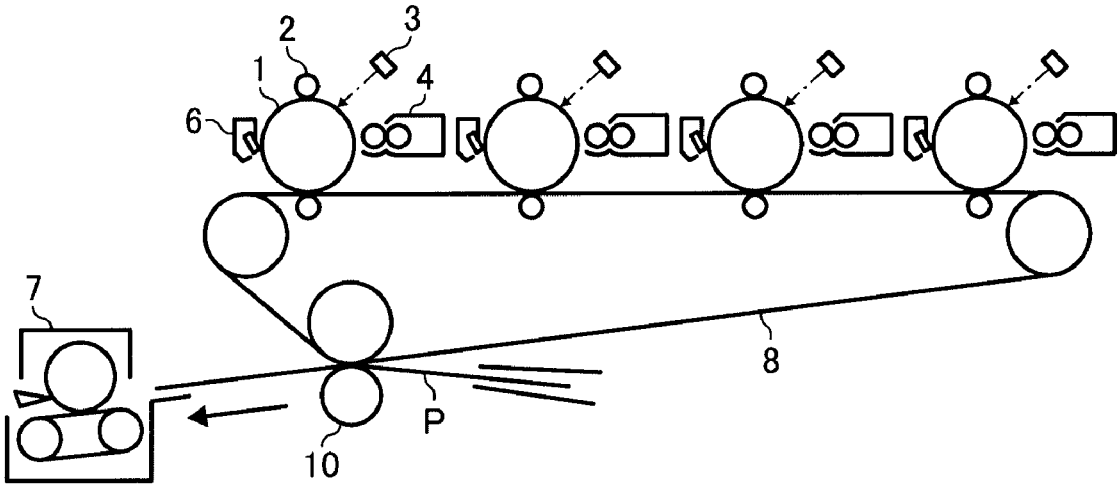
FIG. 2 is a schematic view of a full color image forming apparatus having a fixing device of the first embodiment.

FIG. 2 is a schematic view of a full color image forming apparatus having the fixing device 7 of first embodiment. The full color image forming apparatus has four photoconductive drums 1 corresponding to four different colors of toner. The full color image forming apparatus is called a tandem type image forming apparatus because the four photoconductive drums 1 are arranged in parallel with each other. The structure around each photoconductive drum 1 is the same as the one of the simple color image forming apparatus in FIG. 1 except for the transferring system. The transferring system has two transferring devices, one is an intermediate transferring device 8 and the other is a secondary transferring device 10.

The intermediate transferring device 8 has an intermediate transferring belt which is in contact with the four photoconductive drums 1, and a plurality of rollers which are arranged inside of the intermediate transferring belt and help the intermediate transferring belt to rotate. A secondary transferring roller is in contact with the intermediate transferring belt at the downstream side of the photoconductive drums 1 in the conveying direction of the color toner images. Each color toner image formed on the photoconductive drum 1 by the developing device 4 is transferred to the intermediate transferring device 8 in series. The color toner images are superimposed and become a full color toner image on the intermediate transferring belt. Then, the full color toner image is transferred to a recording medium P, which is conveyed to the contact position between the intermediate transferring belt and the secondary transferring device 10 by the secondary transferring roller. Then, the recording medium P, on which the toner image is transferred, is conveyed to the image fixing device 7. There, the toner image is fixed by heat and pressure provided by the fixing device 7. The recording medium P to which the toner image is fixed is subsequently discharged from the fixing device 7 to the delivery tray (not shown).

Figure 3:
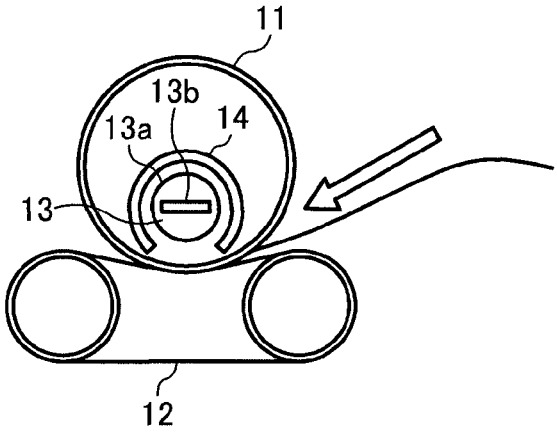
FIG. 3 is a schematic view of the fixing device of the first embodiment.

FIG. 3 is a schematic view of a fixing device 7 of the first embodiment. The fixing device 7 includes a fixing roller 11 which serves as a fixing member that heats and melts toner, a pressurizing belt 12 which serves as a pressurizing member that pressures the recording medium P toward the fixing roller 11, and a carbon lamp 13 that includes a cylindrical glass housing 13*a*, and is made with a carbon material and gives off infrared rays. The pressurizing belt 12 is wound around two rollers and makes a nip area at the pressurizing position at the fixing roller 11. A reflecting member 14, also referred to as a reflector, is arranged opposed to the broad plate of the carbon lamp 13 inside the fixing roller 11. The reflecting member 14 includes a cylindrical shape, part of which is opened towards the nip area, and reflects the infrared rays from the carbon lamp 13 to the nip area and the portion around the nip area. Alternatively, the fixing roller 11 can be replaced with a fixing belt that includes the carbon lamp 13 and the reflecting member 14, and the pressurizing belt 12 can be replaced with a pressurizing roller. According to the invention, any of the embodiments may be implemented with the carbon lamp as the only heat source, and without the use of a halogen lamp, if desired.

Figure 4:
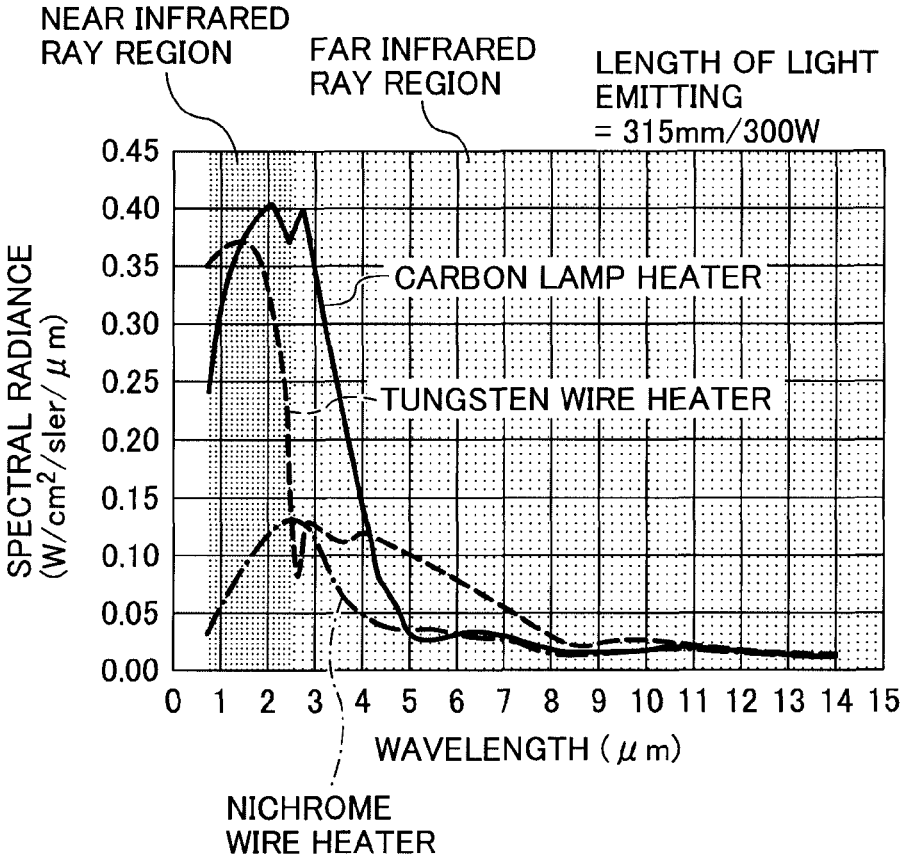
FIG. 4 is a graph showing a relationship between wavelengths of the lights of some heaters for fixing devices and the spectral radiance.

The carbon lamp 13 has properties described with respect to FIG. 4. FIG. 4 is a graph that shows a relationship between wavelengths of the lights of various heaters for fixing devices and the spectral radiance, which describes the comparison between the carbon lamp heater and other heaters, for example, a tungsten wire heater and a nichrom wire heater. A first property is a thermal radiative property at the far infrared ray region. In FIG. 4, the peak wavelength of the light from the carbon lamp exists in a range from 1.5 to 8 μm, which is at the far infrared ray region. Especially, the peak wavelength of the light of the carbon lamp gets centered in the range from 2 to 5 μm, in which there is a high irradiance level of the carbon lamp light. The high irradiance level of the carbon lamp light makes the fixing roller 11 heat the recording medium P effectively, if the fixing roller 11 is made with a material whose heat absorptivity responds to the wavelength of the range from 1.5 to 8 μm, especially from 2 to 5 μm. The materials that includes such heat absorptivity are explained later. In general, the infrared ray is distinguished between the far infrared ray and the near infrared ray at the wavelength value of 2.5 μm. In the explanation of the present invention, light whose wavelength is greater or equal to 2.5 μm is called a far infrared ray, and light whose wavelength is less than 2.5 μm is called a near infrared ray.

The second property is a tolerability of the carbon lamp 11 against an inrush current. A halogen lamp, which is adopted in the conventional fixing device, includes a tungsten wire. The tungsten wire heats well but the resistance of the tungsten wire is so small in a room temperature that the inrush current, which is from several to dozens of times the current rating, happens sometimes at an initial energization. To prevent the inrush current, the conventional art offers an addition of a protection circuit such as inrush current suppressors to a circuit for the halogen lamp. To the contrary, the resistance of a carbon plate 13*b* of the carbon lamp 13 is much larger than the resistance of the tungsten wire. There is some data of the volume resistivity of the same form test pieces in 20° C. circumstance. The volume resistivity of the tungsten piece is 5.6×10-8 Ω·m and the volume resistivity of the carbon piece is 3352.8×10-8 Ω·m, i.e., carbon resistance is about six hundred times larger than tungsten resistance in 20° C. As a result, the carbon lamp 13 prevents the inrush current from occurring at the initial energization in room temperature.

A third property is a rapid temperature rise of the carbon lamp 13. The carbon lamp 13 heats up to its maximum temperature in several seconds after the initial energization. As explained above, the resistance of the carbon plate 13*b* is so large that a heat amount, which happens at the same time of energization, is also large. Additionally, molding the shape of the carbon plate 13*b* is easy so it is not difficult to design the cross section of the carbon plate 13*b*, which makes a large current get through the cross section even when a large voltage is applied to the carbon plate 13*b*. As a result, the carbon lamp 13 can heat up rapidly. The amount of passing current in the carbon plate 13*b* is so large and the resistance of the carbon plate 13*b* is so large that the heat amount produced from the carbon lamp 13 per unit time is also large. The carbon lamp 13 is an effective heating device and has the three properties explained above. However, to broaden simply the cross section of the carbon plate 13*b* makes the heat produced by the carbon plate 13*b* sprawl. As a result, it is difficult for the carbon lamp 13 to heat up the nip area intensively. Therefore in the first embodiment, the carbon plate 13*b* includes a thin rectangle, and one of the broader surfaces in the rectangle is arranged opposed to the nip area. The design of the carbon plate 13*b* helps almost half of the light amount produced by the carbon plate 13*b* to arrive at the nip area directly, in theory. Furthermore the first embodiment adopts the reflecting member or reflector 14. The reflecting member 14 includes a cylindrical shape, part of which is opened towards the nip area and reflects the infrared rays given off from the carbon lamp 13 to the nip area and the portion around the nip area. The cylindrical shape is made with stainless, for example, and the inner surface of the cylindrical shape is mirrored. Alternatively, the cylindrical shape may be made with a base cylindrical portion and a lamination layer made of aluminum foil and glass is formed on the inner surface of the base cylindrical portion. The light given off from the carbon lamp 13, which does not directly arrive at the nip area, is reflected by the reflecting member 14 to the nip area via an opening of the cylindrical shape of the reflecting member 14.

Figure 5:
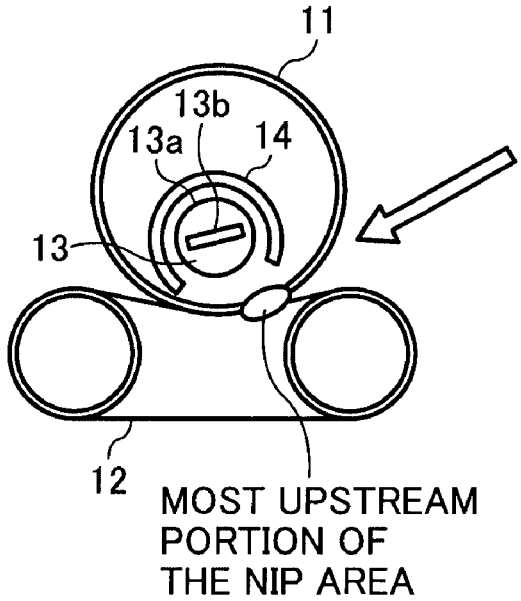
FIG. 5 is a schematic view of a fixing device of a second embodiment.

FIG. 5 is a schematic view of a fixing device of a second embodiment. If there is a long distance between the carbon lamp 13 and the nip area, some loss of heat occurs in heat transfer from the carbon lamp 13 to the nip area. However, in this second embodiment, the transfer direction of the infrared ray, which is given off by the carbon lamp 13, is mainly toward a most upstream portion of the nip area in the conveying direction of the recording medium P. To be more precise, the opening of the reflecting member 14 is opposite to the most upstream portion of the nip area in the conveying direction of the recording medium P. It is preferable to make the carbon plate 13*b* opposite to the most upstream portion of the nip area together. The arrangement of the reflecting member 14 and the carbon plate 13*b* towards the most upstream portion of the nip area prevents the loss of heat.

Figure 6:
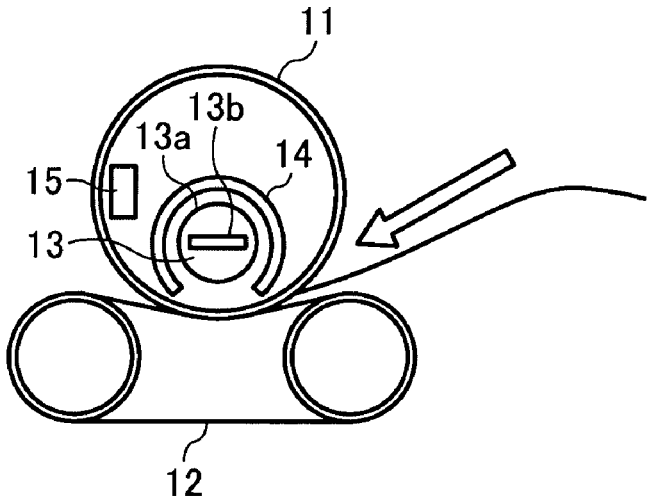
FIG. 6 is a schematic view of a fixing device with a thermistor.

The improved embodiment based on embodiment 1 is shown in FIG. 6. FIG. 6 is a schematic view of a fixing device 7 with a thermistor 15. The thermistor 15 is arranged inside the fixing roller 11 in contact with the inner surface of the fixing roller 11. If the thermistor 15 is contact with the outer surface of the fixing roller 11, which is at the side of contacting with the recording medium P, the thermistor 15 will make the fixing performance become worse. If desired, the thermistor 15 does not need to contact the inner or outer surface of the fixing roller 11. The thermistor 15 detects a temperature of the fixing roller 11 so that the temperature of the fixing roller 11 can be controlled to be within a certain range. It is further preferable that the fixing roller 11 is made with a material which has high heat conductivity like copper, although this is not required. It is because of a temperature difference between a part surface which contacts the recording medium P and other part surface which does not contact the recording medium P which makes the accuracy of detecting the surface temperature of the fixing roller 11 by the thermistor 15 worse. Therefore, the fixing roller 11 made with copper or copper alloy, for example, whose heat conductivity is high, makes the temperature difference as small as possible and the accuracy of detecting the surface temperature of the fixing roller 11 by the thermistor 15 go up. The thermistor may be applied to any embodiment described herein.

Figure 7:
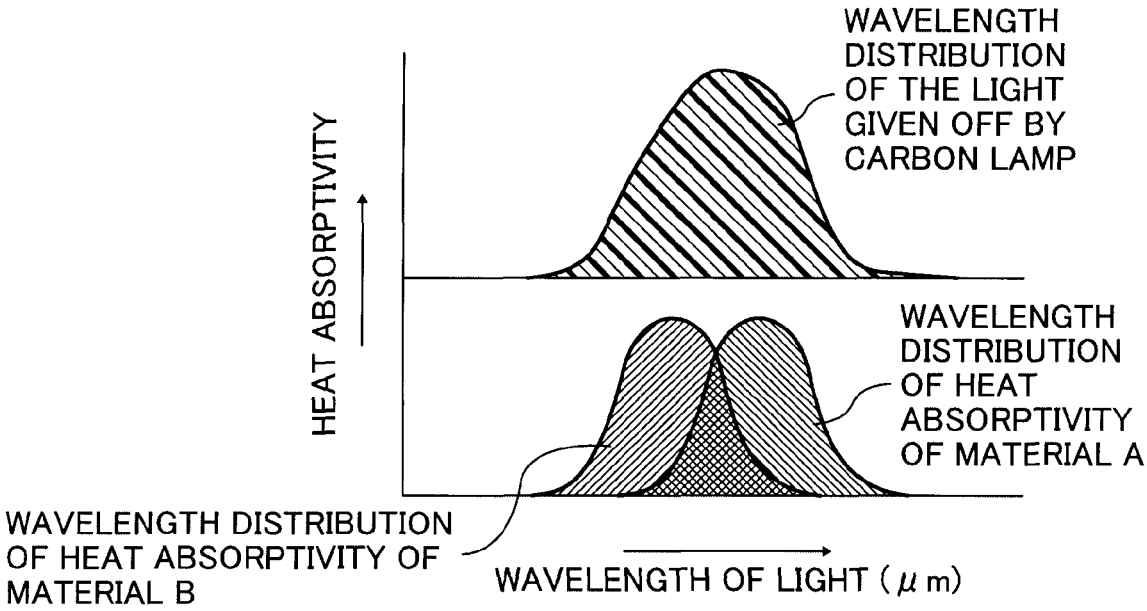
FIG. 7 is a graph showing a relationship between a wavelength distribution of the light given off by the carbon lamp and two wavelength distributions of heat absorptivity of two different materials A and B.

The third embodiment of the present invention will now be described. FIG. 7 is a graph of a relationship between a wavelength distribution of the light given off by the carbon lamp 13 and two wavelength distributions of heat absorptivity of two different materials A and B. The upper graph shows the wavelength distribution of the light given off by the carbon lamp 13. The lower graph shows the two wavelength distributions of heat absorptivity of the two different materials, A and B. As described in the explanation of FIG. 4, the carbon lamp 13 gives off infrared rays effectively and the peak wavelength of the light of the carbon lamp 13 exists in a range from 1.5 to 8 μm, and is especially centered in a range from 2 to 5 μm.

On the condition that the upper graph's wavelength distribution of the light which is given off by the carbon lamp 13 corresponds to the far infrared ray's range from 2.5 to 8 μm, either lower graph's wavelength distribution of heat absorptivity which is the fixing member's material A or B shown in FIG. 7 will not correspond to all wavelength distribution range of the far infrared rays. As a result, either fixing member 11 made with the material A or B can not absorb all of the heat energy of the far infrared rays, and consumes away some of the heat energy.

On the condition that each material has a limited wavelength distribution range of heat absorption, it is preferable for the fixing member 11 to be made with a plurality of the materials which have different heat absorptivities from each other. The fixing member 11 broadens the wavelength range in which the fixing member 11 can absorb the heat energy. As a result, the fixing member 11 can heat up effectively.

Figure 8:
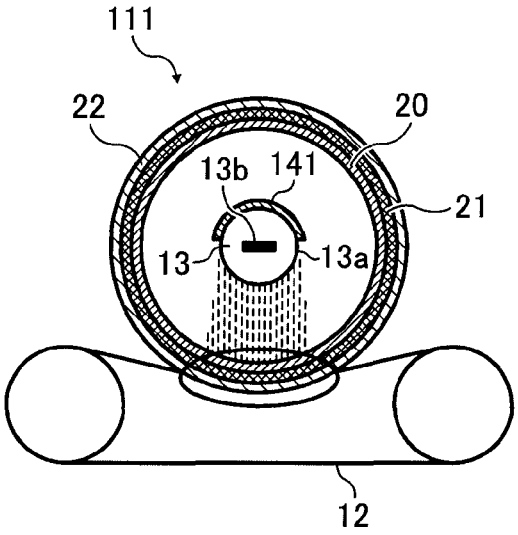
FIG. 8 is a schematic view of a fixing device of a third embodiment.

FIG. 8 is a schematic view of a fixing device of a third embodiment in which the fixing member is made with a plurality of the materials which have different heat absorptivities. The fixing device of the third embodiment includes a fixing roller 111 which is a fixing member that heats and melts toner, a pressurizing belt 12 which is a pressurizing member that pressures the recording medium P toward the fixing roller 111, and a carbon lamp 13 that is made with a carbon material and gives off infrared rays. The fixing roller 111 is made with a plurality of layers below. An inner layer 20, which is a third layer, includes an inner surface which faces the carbon lamp 13 and absorbs the infrared rays. A surface layer 22, which is a first layer, contacts the recording medium P and the pressurizing belt 12. A middle layer 21, which is a second layer, is made with metal and conveys heat from the inner layer 20 to the surface layer 22. The three layers have different heat absorptivities from each other. The pressurizing belt 12 is wound around two rollers and makes a nip area at the pressurizing position towards the fixing roller 111. The carbon lamp 13 is supported inside of the fixing roller 111 and preferably do not contact each other.

The carbon lamp 13 includes a cylindrical glass housing 13*a* and a carbon plate 13*b* inside the glass housing 13*a*. A cross section of the carbon plate 13*b* is a thin rectangle because the thin plate has two broader surfaces and the broad surfaces direct the irradiation of the infrared ray in a certain line opposed to the broad surfaces. A lamination layer 141, which is an evaporated reflecting member, is evaporated on the glass housing 13*a* of the carbon lamp 13.

Preferable materials for the lamination layer 141, which include high heat reflectivities against the carbon lamp's infrared wavelength from 1 to 10 μm, include e.g. aluminum, gold, silver, copper and the like. It is preferable to evaporate the lamination layer 141 directly on the glass housing 13*a* because the lamination layer 141 gives some directivities to the infrared ray of the carbon lamp 13. However, this is not required. It is also preferable to make the lamination layer 141 on the glass housing 13*a* by sputtering. The surface layer 22 is made with a heat resistant material which is elastic and releasable for the recording medium, e.g. silicone, Teflon coat and the like. The middle layer 21 supports the inner layer 20 and the surface layer 22, and is made with a high heat conductive material which is rigid, e.g. iron, copper, copper alloy, and aluminum. The inner layer 20 is made with a material which absorbs the infrared ray effectively and whose surface does not reflect the infrared ray. It is preferable for the inner layer 20 to be made with a material which has a heat absorptivity for a wavelength range from 1.5 to 8 μm. The infrared rays are distinguished into two types; near infrared rays less than 2.5 μm and far infrared rays from 2.5 to 1000 μm.

Infrared rays are electromagnetic rays, and electromagnetic rays vibrate molecules in the material of the fixing member 111. The heat absorptivity from the infrared rays is determined by the molecular binding. Materials which absorb the infrared ray effectively and are preferable materials for the inner layer 20 include natural resin, synthetic resin, rubber, coating medium, wood, fabric, glass, natural ceramics, and artificial ceramics.

An organic matter's wavelength of heat absorptivity corresponds to the wavelength of the infrared ray, and organic matter is preferable for the material of the inner layer 20. Moreover, ceramics which contains alumina or zirconia are also preferable materials for the inner layer 20.

There are some methods to manufacture the inner layer of ceramics, e.g. coating ceramics on the middle layer 21, presintering ceramics, and thermal spraying of ceramics. Thermal spraying is preferable to other methods because thermal spraying allows the free selection of material and does not restrict the shape of middle layer 21. However, the invention is not limited to thermal spraying.

Moreover, an oxidized metal is also a preferable material for the inner layer 20 because the oxidized metal absorbs infrared rays effectively. Moreover black chrome plating is also a preferable method for making the inner layer 20. The wavelength of the near infrared ray is shorter than the wavelength of the far infrared ray and overlaps a range of optical wavelengths. A heat absorptivity of the optical wavelength depends on the color of the surface to which the light is irradiated. Accordingly dark color or black is preferable for the surface color in order to absorb the heat energy of near infrared rays, and this is the reason why black chrome plating is also preferable for the inner layer 20. A method of mixing the inner layer 20 materials with carbon or an oxidized metal is also preferable in order to make the inner layer 20 black. Carbon is a preferable material to absorb the heat energy of the infrared rays.

Moreover the heat absorptivity from infrared rays depends on differences of surface properties of the inner layer 20, even if the inner layer 20 is made with the same material and color. The heat absorptivity is expressed by the following formula:

$$\text{heat absorptivity}+\text{heat reflectivity}+\text{heat transmissivity}=1$$

The more specular the inner layer surface becomes, the larger the heat reflectivity of the inner layer 20 is and the smaller the heat absorptivity of the inner layer 20 is. In contrast, it is preferable to make the inner layer 20 surface rough in order to make the heat absorptivity large, because a rough surface maintains a small heat reflectivity. The surface of the inner layer 20 may be made rough by sandblasting, grinding, and/or thermal spraying a resin or ceramic. A preferable roughness is equal or more than Ra 1 μm. In order to convey heat from the inner layer 20 to the surface layer 22, it is preferable to make all three layers as thin as possible. For example, a preferable thickness of the inner layer 20 is equal to or less than 0.5 mm. A 200 μm thickness of the inner layer 20 is enough to absorb the heat energy from the infrared rays. It is also preferable to nickelize the middle layer 21 with a nickel layer of the thickness from 20 to 200 μm. A preferable thickness of the surface layer 22 is from 20 to 300 μm because such thickness prevents uneven luster gloss or creases on the recording medium P from occurring. FIG. 9 is a table of groups described as structure formulas and wave numbers of the infrared property absorption band. The left column indicates the type of molecular vibration, the center column indicates the wave number, and the right column indicates the shape or type of chemical compound.

Figure 11:
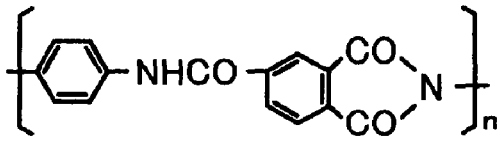
FIG. 11 describes a suitable polyamideimide.
Figure 12:
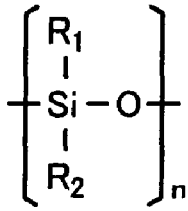
FIG. 12 describes a suitable silicone.

Various polymers and molecular structures or compounds may be utilized with the invention. FIGS. 10A and 10B are suitable polyimides. FIG. 11 is a polyamideimide which may be used with the invention. FIG. 12 shows silicones which may be used with the invention. FIGS. 13A and 13B are intermediate forms of phenols which may be used with the invention. FIG. 14 shows a suitable table of molecular ketone-polyether which may be used with the invention. It is preferable that the inner layer 20 has a heat resistance property because the temperature of the fixing member 111 rises up until about 200° C. The preferable heat resistance material for the inner layer 20 is a thermoset resin. Polyimide, polyamide, polyamideimide, silicone, and phenol are the thermoset resin which can be used in 200° C. circumstances. Moreover some thermoplastic resins are also preferable for the material of the inner layer 20, e.g. ketonepolyether. The melting temperature of ketonepolyether is 375° C. and is sufficiently high to resist against heat.

Polyimides which include [—NH] radicals and [C—O] radicals in their molecular feature or structure effectively absorb infrared wavelengths from 2.8 to 3.1 μm and from 9.2 to 9.5 μm. Polyamideimides include [—NH] radicals in their molecular feature or structure and effectively absorb infrared wavelengths from 2.8 to 3.1 μm. Silicone includes a [—OH] radical and a [—$CH_3$] radical in its molecular feature or structure and effectively absorbs infrared wavelengths from 2.9 to 3.2 μm and from 6.6 to 6.9 μm. Phenols include [—OH] radicals and [—$CH_2$] radicals in their molecular feature or structure and effectively absorb infrared wavelengths from 2.9 to 3.2 μm and from 6.6 to 6.9 μm.

Ketone polyether includes a [>C=O] radical in its molecular feature or structure and effectively absorbs infrared wavelengths from 5.5 to 6.1 μm. Polyimide, polyamide, polyamideimide, silicone, phenol, and ketone polyether are preferable materials for the inner layer 20 because they have some preferable radicals for infrared absorption in their molecular features and high heat resistances. As well as the first embodiment, the embodiments described in FIGS. 3, 5, 6, and 8 also may utilize a fixing belt instead of fixing roller and a pressurizing roller instead of the pressurizing belt respectively.

Figure 15A:
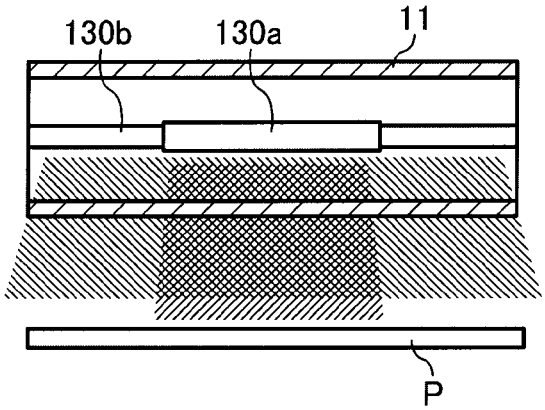
FIG. 15A is a schematic cross sectional view of a fixing device of a fourth embodiment.
Figure 15B:
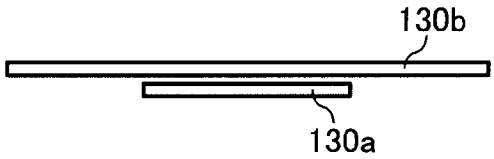
FIG. 15B is a schematic upper view of a fixing device of the fourth embodiment.

FIG. 15A is a cross sectional schematic view of a fixing device of the fourth embodiment. FIG. 15B is a schematic upper view of a fixing device of the fourth embodiment. The fixing device of the fourth embodiment has the same components as the first embodiment except the carbon lamp 13, and detailed drawings and explanations of the same components are omitted. The fixing device of the fourth embodiment includes two types of carbon lamps, a short carbon lamp 130*a* and a long carbon lamp 130*b* in the fixing roller 11 shown in FIGS. 15A and 15B. The short carbon lamp 130*a* is arranged at an inside center of the fixing roller 11 and parallel to the long carbon lamp 130*b*. When a small width recording medium P passes, the short carbon lamp 130*a* only turns on provides infrared rays to the fixing roller 11. When a large width recording medium P passes, a CPU equipped in the image forming apparatus switches over from the short carbon lamp 130*a* to the long carbon lamp 130*b*, and the long carbon lamp 130*b* only turns on and emits infrared rays to the fixing roller 11.

Figure 16:
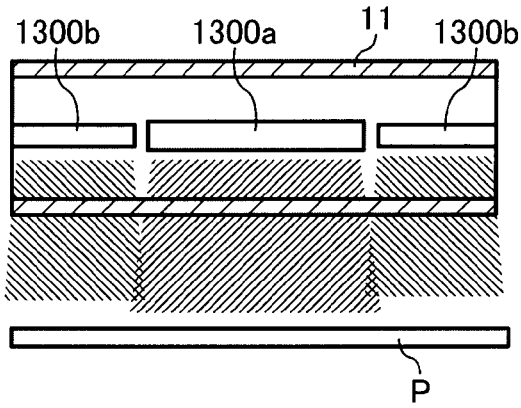
FIG. 16 is a schematic view of a fixing device of a fifth embodiment.

FIG. 16 is a schematic cross sectional view of a fixing device of a fifth embodiment. The fixing device of the fifth embodiment has the same components as the first embodiment except the carbon lamp 13, and detailed drawings and explanations of the same components are omitted. The fixing device of the fifth embodiment includes three separate carbon lamps, a center carbon lamp 1300*a* which is arranged at an inside center of the fixing roller 11, and two side carbon lamps 1300*b* which are arranged in a line at both sides of the center carbon lamp 1300*a*. When a small width recording medium P passes, the center carbon lamp 1300*a* only turns on and emits infrared rays to the fixing roller 11. When a large width recording medium P passes, a CPU equipped in the image forming apparatus also turns on the side carbon lamps 1300*b* so that all three carbon lamps emit infrared rays to the fixing roller 11. Overlapped areas on the inner surface of the fixing roller 11, to which both the center carbon lamp 1300*a* and the side carbon lamps 1300*b* emit infrared rays are small enough so as not to overheat the fixing roller 11. The light given off by the carbon lamps 1300*a* and 1300*b* have light directivity and can be arranged not to give off light redundantly, or in an amount which causes any significant issues.

The present invention may be implemented using a controller, processor, or microprocessor. The coding or programming for these devices can readily be prepared by skilled programmers based on the teachings of the present disclosure. The invention may also be implemented by the preparation of application specific integrated circuits or by connecting an appropriate network of conventional component circuits, as will be readily apparent to those skilled in the art.

The present invention also includes a computer program product which is a storage medium including instructions which can be used to program a computer to perform a process of the invention. The storage medium can include, but is not limited to, any type of disk including floppy disks, optical disks, CD-ROMs, and magneto-optical disks, ROMs, RAMs, EPROMs, EEPROMs, flash memory, magnetic or optical cards, or any type of media suitable for storing electronic constructions. The invention also includes a memory such as any of the described memories herein which store data structure corresponding to the information described herein. Moreover, the invention also includes signals such as carrier waves which transmit the data structures and also the software coding corresponding to the computer program product of the invention.

Obviously, numerous modifications and variations of the present invention are possible in light of the above teachings. It is therefore to be understood that within the scope of the appended claims, the invention may be practiced otherwise than as specifically described herein.

What is claimed is:

1. An image fixing device for use in an image forming apparatus, comprising:

a fixing member that includes a plurality of materials which have different heat absorptivities, the fixing member being configured to fix a toner image on a recording medium at a nip area;

a pressurizing member configured to pressure the recording medium toward the fixing member at the nip area;

a carbon lamp configured to give off infrared rays; and a reflector configured to reflect the infrared rays to the nip area.

2. The image fixing device according to claim 1, wherein:

the reflector reflects the infrared rays to a most upstream portion of the nip area in a conveying direction of the recording medium.

3. The image fixing device according to claim 2, wherein:

the carbon lamp includes an evaporated reflector thereon.

4. The image fixing device according to claim 1, wherein:

the fixing member includes a blend of the plurality of materials.

5. An image fixing device for use in an image forming apparatus, comprising:

a fixing member configured to fix a toner image on a recording medium at a nip area;

a pressurizing member configured to pressure the recording medium toward the fixing member at the nip area;

a carbon lamp configured to give off infrared rays; and a reflector configured to reflect the infrared rays to the nip area, wherein the fixing member includes:

a first layer configured to contact the recording medium, a second layer which conveys heat to the first layer, and a third layer which includes a surface which faces the carbon lamp, wherein:

the first, second, and the third layers have different heat absorptivities.

6. The image fixing device according to claim 5, wherein:

a heat absorptivity of the third layer is higher than the heat absorptivity of the first and second layers.

7. The image fixing device according to claim 6, wherein:

the third layer includes a material for which far infrared rays and near infrared rays are absorptive more effectively than materials of the first and second layers.

8. The image fixing device according to claim 7, wherein:

the material of the third layer includes an organic material.

9. The image fixing device according to claim 8, wherein:

the material of the third layer includes a heat resistant resin.

10. The image fixing device according to claim 6, wherein:

a color of an outer surface of the third layer is black.

11. The image fixing device according to claim 6, wherein:

an outer surface of the third layer is a rough surface.

12. The image fixing device according to claim 6, wherein:

a thickness of the third layer is not more than 0.5 mm.

13. An image fixing device for use in an image forming apparatus, comprising:

a fixing member that includes a plurality of materials which have different heat absorptivities, the fixing member being configured to fix a toner image on a recording medium at a nip area;

a pressurizing member configured to pressure the recording medium toward the fixing member at the nip area;

a plurality of carbon lamps configured to emit infrared rays; and a reflector configured to reflect the infrared rays to the nip area, wherein:

the plurality of carbon lamps are arranged in the width direction of the fixing member.

14. The image fixing device according to claim 13, wherein:

the reflector reflects the infrared rays to a most upstream portion of the nip area in a conveying direction of the recording medium.

15. An image forming apparatus, comprising:

an image carrier configured to carry a toner image;

a transfer apparatus configured to transfer the toner image from the image carrier to a surface of a recording medium; and an image fixing device, including a fixing member that includes a plurality of materials which have different heat absorptivities, the fixing member being configured to fix the toner image on the recording medium at a nip area;

a pressurizing member configured to pressure the recording medium toward the fixing member at the nip area;

a carbon lamp configured to give off infrared rays; and a reflector configured to reflect the infrared rays to the nip area.

16. The image forming apparatus according to claim 15, wherein:

the reflector reflects the infrared rays to a most upstream portion of the nip area in a conveying direction of the recording medium.

17. An image forming apparatus, comprising:

an image carrier configured to carry a toner image;

a transfer apparatus configured to transfer the toner image from the image carrier to a surface of a recording medium; and an image fixing device, including a fixing member configured to fix the toner image on the recording medium at a nip area;

a pressurizing member configured to pressure the recording medium toward the fixing member at the nip area;

a carbon lamp configured to give off infrared rays; and a reflector configured to reflect the infrared rays to the nip area, wherein:

the fixing member includes a first layer configured to contact the recording medium, a second layer which conveys heat to the first layer, and a third layer which includes a surface which faces the carbon lamp, wherein:

the first, second, and the third layers have different heat absorptivities.

18. The image forming apparatus according to claim 17, wherein:

a heat absorptivity of the third layer is higher than the heat absorptivity of the first and second layers.

19. The image forming apparatus according to claim 18, wherein:

the third layer includes a material for which the infrared rays and near infrared rays are absorptive more effectively than materials of the first and second layers.

* * * * *